US005515959A

United States Patent [19]

Stephenson, III et al.

[11] Patent Number: 5,515,959

[45] Date of Patent: May 14, 1996

[54] HINGE FOR BILL ACCEPTOR DOOR ON GAMING DEVICE

[75] Inventors: Orlando W. Stephenson, III, Kentwood; Lee M. Terpstra, Caledonia, both of Mich.

[73] Assignee: SPEC International, Grand Rapids, Mich.

[21] Appl. No.: 233,076

[22] Filed: Apr. 26, 1994

[51] Int. Cl.[6] ..... G07F 7/04; G07F 17/34

[52] U.S. Cl. ..... 194/206; 16/267; 49/398; 194/350

[58] Field of Search ..... 194/206, 207, 194/350; 16/267; 49/398; 232/15, 16; 109/51, 52; 273/138 A

[56] References Cited

U.S. PATENT DOCUMENTS

| | | | |
|---|---|---|---|
| 5,048,154 | 9/1991 | Swartzendruber | 16/267 |
| 5,121,824 | 6/1992 | Halsey et al. | 194/350 |

FOREIGN PATENT DOCUMENTS

| | | | |
|---|---|---|---|
| 2-93890 | 4/1990 | Japan | 194/206 |

*Primary Examiner*—F. J. Bartuska

*Attorney, Agent, or Firm*—Price, Heneveld, Cooper, DeWitt & Litton

[57] ABSTRACT

A bill acceptor door is pivotally mounted to a cabinet access door of a cabinet by a hinge arrangement that facilitates assembly, but which provides secure retention of the bill acceptor door. In particular, tile hinge arrangement includes a hinge bracket defining a pair of slots, and the bill acceptor door includes a housing defining a pair of slot engaging pivot pins. The housing is configured to securely receive a bill acceptor and a bill collector cartridge, but only after the bill acceptor door is mounted on the cabinet. The bill acceptor door can be oriented in the intermediate position so that the pivot pins will slidingly engage the slots. The hinge bracket further defines fingers which engage the restrictive space between the pivot pins and the bill acceptor door to interlockingly engage the pivot pins and thus securely retain tile bill acceptor door to the hinge bracket when the bill acceptor door is located between the intermediate and open positions.

7 Claims, 3 Drawing Sheets

HINGE FOR BILL ACCEPTOR DOOR ON GAMING DEVICE

BACKGROUND OF THE INVENTION

The present invention relates to gaming devices, and in particular to a hinge arrangement for a bill acceptor door that facilitates assembly but which is also necessarily secure.

Gaming devices are apparatus which award winnings to players in a game based on probabilities and statistics. Typically, the devices include a central unit for controlling the game, a display, and a keyboard or other operator controlled input mechanism. These components are stored in or attached to a cabinet defining a secure enclosure, and a bill or coin acceptor is secured in the cabinet for receiving bills or coins to play the game. In the event a bill acceptor is included, the bill acceptor is typically mounted on a cabinet access door in tile front of the cabinet. This positions the bill acceptor in a convenient location in front of the gaming device for inserting bills, and also allows convenient removal of bills collected by the bill acceptor. The front mounted cabinet access door also allows the central unit to be serviced through the front of the cabinet.

It is desirable to mount the bill acceptor to the front of tile cabinet access door for easy access. However, this presents a security problem since thieves are particularly ingenious at surreptitiously overcoming locks, hinges, and other detachment devices for securing the bill acceptor to the cabinet access door. In an effort to thwart thieves, attachment devices have become heavy, bulky, complex, difficult to assemble, and costly.

Thus, a device solving the aforementioned problems is desired.

SUMMARY OF THE INVENTION

The present invention includes a hinge arrangement for a gaming device including a cabinet defining an opening, a lockable bill acceptor door shaped to cover the opening, and a bill acceptor having a removable bill collector cartridge positioned proximate the opening. A hinge bracket including hinge-pin-engaging slots and interlocking fingers is attached to the cabinet proximate the opening, and a housing including pivot pins for operably engaging the slots in the hinge bracket is secured to the bill acceptor door for holding the bill acceptor. The bill acceptor door is pivotable between the closed position for receiving bills and securely holding the bill collector cartridge in a safe position, an open position for accessing the bill acceptor to remove the bill collector cartridge, and an intermediate position facilitating assembly of the bill acceptor door to the hinge bracket. The pivot pins and tile bill acceptor housing define a restrictive space therebetween for closely receiving the interlocking fingers, and the interlocking fingers have a configuration such that the restrictive space allows insertion of the pivot pins into and out of the inlet of the slots only when the bill acceptor door is in the intermediate position. Thus, the arrangement prevents withdrawing the pivot pins frown the slots through the inlets when tile bill acceptor door is between the intermediate position and the open position. This arrangement facilitates assembly yet provides a secure arrangement.

These and other features and advantages of the present invention will be further understood and appreciated by those skilled in the art by reference to the following specification, claims and appended drawings.

DETAILED DESCRIPTION OF PREFERRED EMBODIMENT

Figure 1:
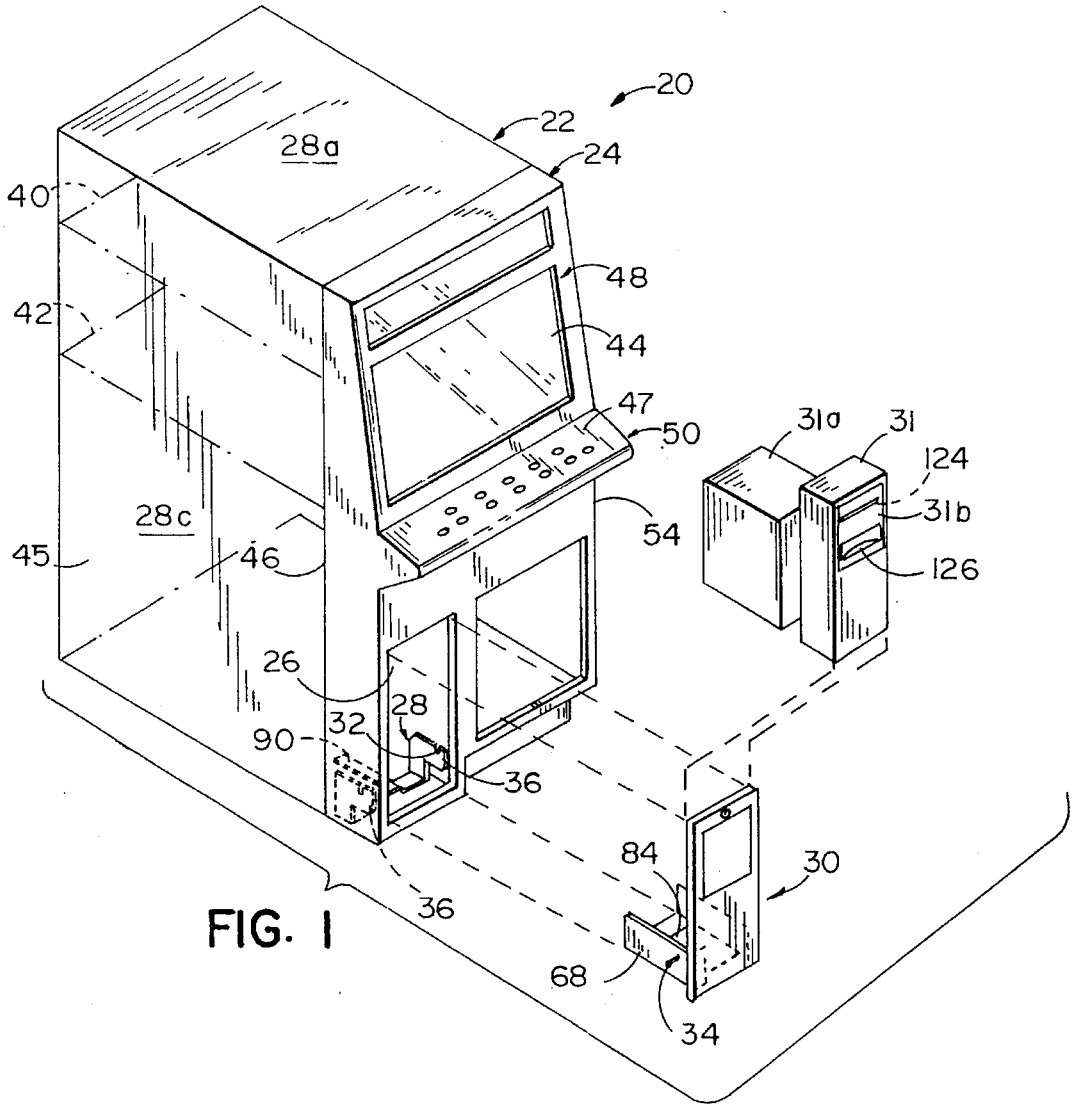
FIG. 1 is a partially exploded perspective view of a gaming device embodying the present invention.
Figure 2:
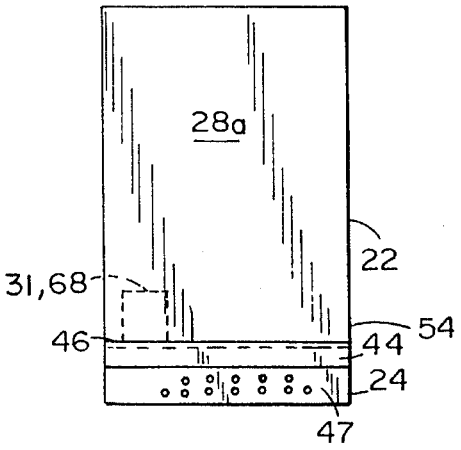
FIG. 2 is a top view of the gaming device shown in FIG. 1, the cabinet access door being shown in the closed position.
Figure 3:
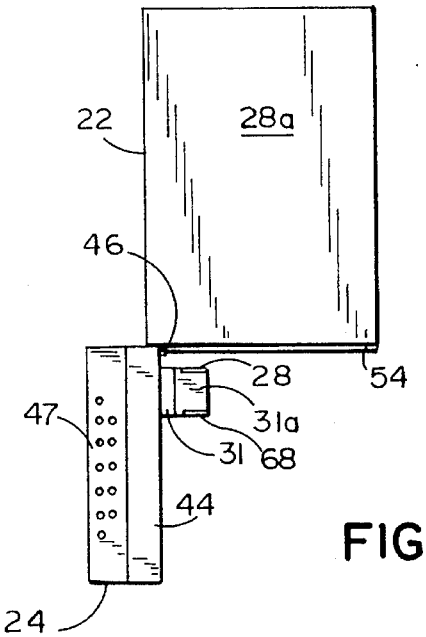
FIG. 3 is a top view of the gaming device shown in FIG. 1, the cabinet access door being shown in the open position.
Figure 4:
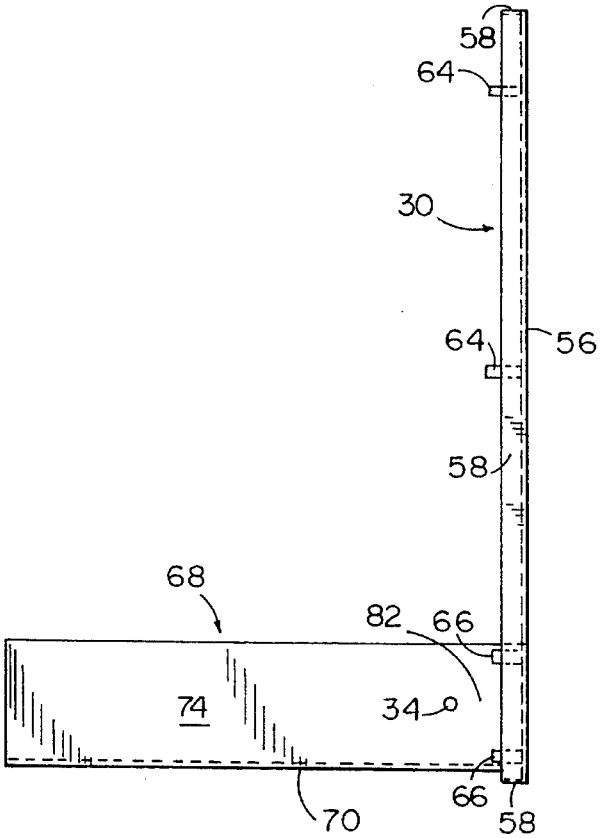
FIG. 4 is a side view of the bill acceptor door and housing shown in FIG. 1.
Figure 5:
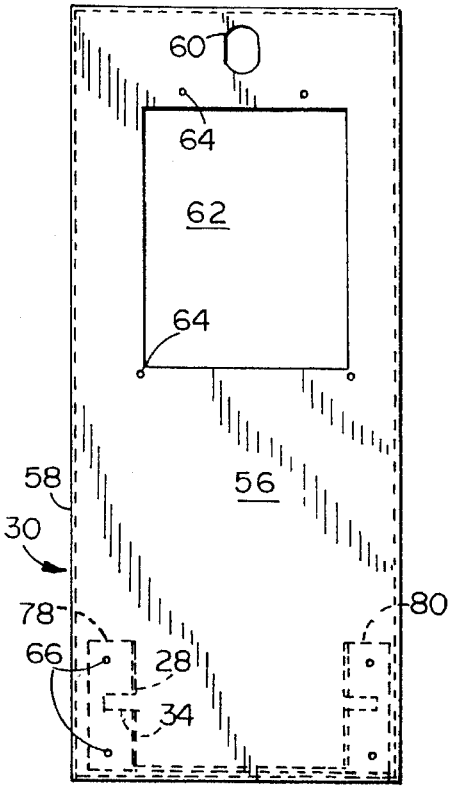
FIG. 5 is a front view of the bill acceptor door and housing shown in FIG. 4.
Figure 6:
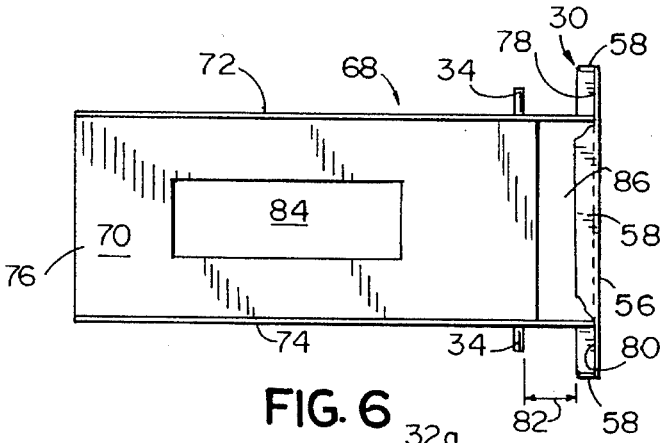
FIG. 6 is a top view of the bill acceptor door and housing shown in FIG. 4.

For purposes of description hearing, the terms "upper," "lower," "right," "left," "rear," "front," "vertical," "horizontal," and derivatives thereof shall relate to the invention as oriented in FIG. 1 with the video display being viewable from the front of the gaming device. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments enclosed wherein are not to be considered as limiting, unless the claims expressly state otherwise.

Figure 7:
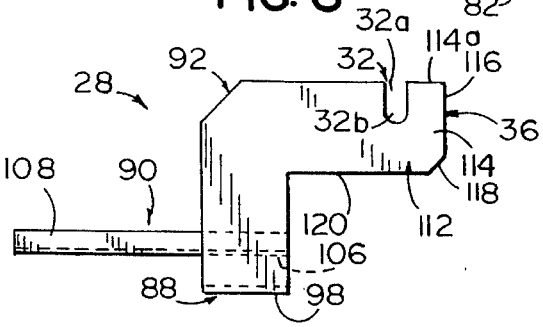
FIG. 7 is a side view of the hinge bracket shown in FIG. 1.
Figure 9:
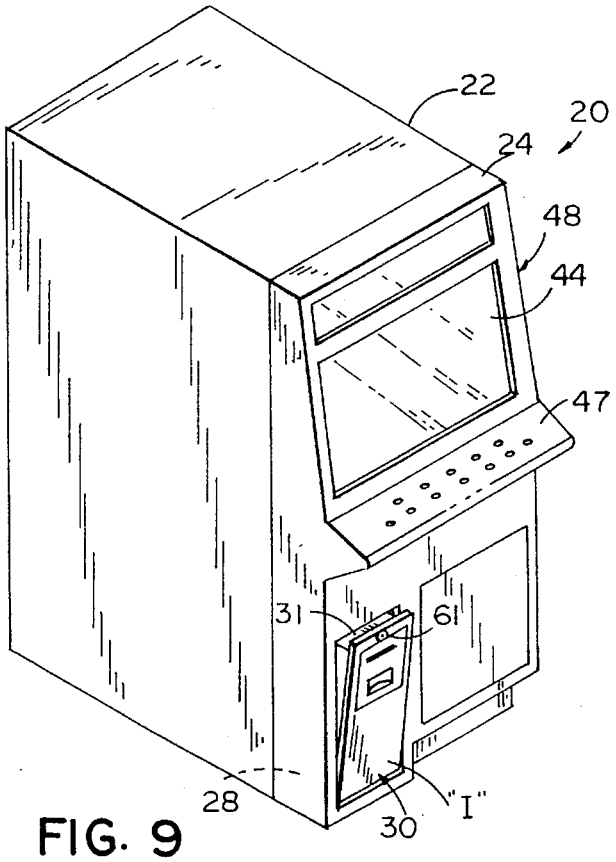
FIG. 9 is a perspective view of the gaming device, the bill acceptor door being shown in the intermediate position.
Figure 10:
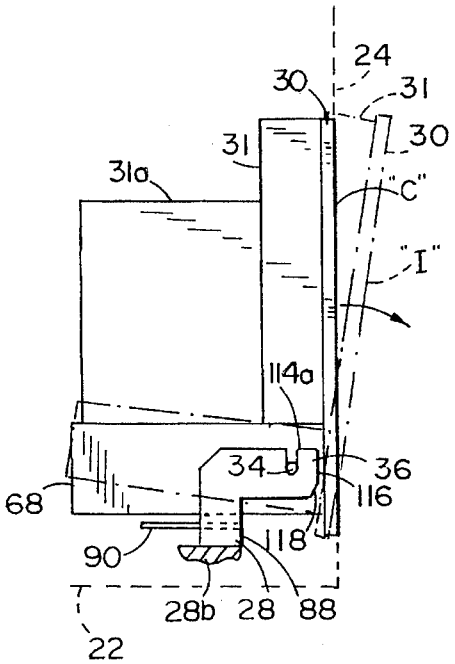
FIG. 10 is a fragmentary enlarged side: view of the hinge arrangement shown in FIG. 9.
Figure 11:
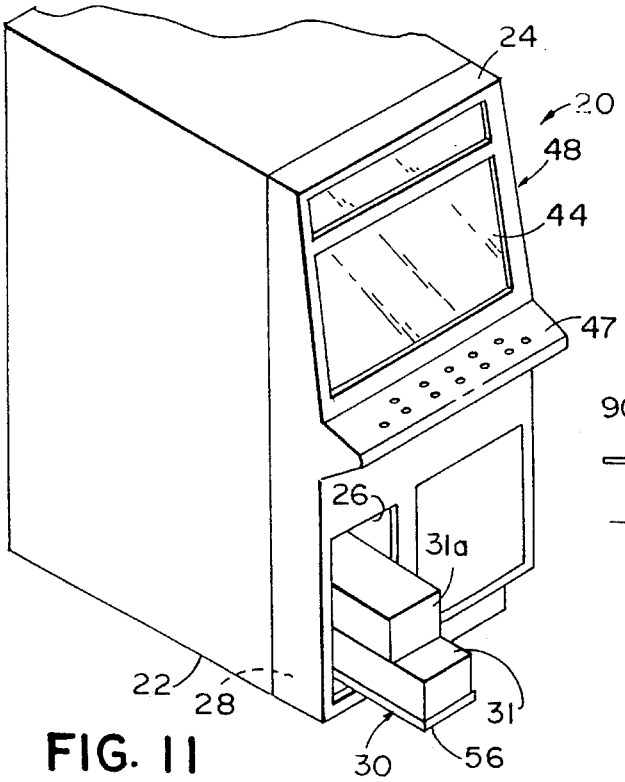
FIG. 11 is a perspective view of the ginning device shown in FIG. 9, the bill acceptor door being shown in the open position.
Figure 12:
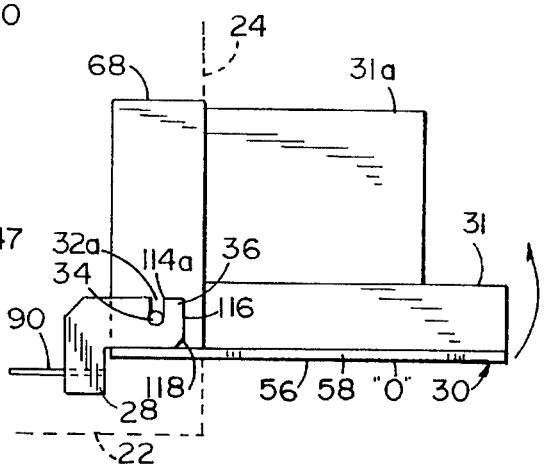
FIG. 12 is a fragmentary side view of the bill acceptor door shown in FIG. 11.

A gaming device 20 (FIG. 1 ) embodying the present invention includes a cabinet 22 and a cabinet access door 24 pivotally mounted to the front of cabinet 22. Cabinet access door 24 includes an opening 26 in its lower left hand corner, and a hinge bracket 28 is mounted adjacent opening 26. A bill acceptor door 30 shaped to fit within, close and/or cover opening 26 is pivotally mounted to hinge bracket 28 for movement between a closed position "C" (FIG. 10), an intermediate position "I" (FIGS. 9–10), and an open position "O" (FIGS. 11–12). A bill acceptor 31 is secured to bill acceptor door 30 so that, when door 30 is open, bill acceptor 31 can be accessed, such as to remove a bill collector cartridge 31*a* including collected bills. Hinge bracket 28 includes slots 32 (FIGS. 1 and 7) and bill acceptor door 30 includes slot engaging pivot pins 34 (FIGS. 1 and 4–6) such that door 30 can be slideably assembled to hinge bracket 28 when door 30 is oriented between the closed and intermediate positions. However, when bill acceptor door 30 is between the intermediate and open positions and when bill acceptor 31 is mounted to bill acceptor door 30, bill acceptor door 30 cannot be removed since interlocking fingers 36 on the end of hinge bracket 28 interlockingly engage pivot pins 34 and the front of bill acceptor door 30 to thus prevent removal.

Cabinet 22 (FIG. 1 ) includes a top 28*a*, a bottom 28*b* and sides 28*c* which define an interior space, and includes various shelves such as an upper shelf 40 for supporting a gaming device central control unit (not specifically shown), a second shelf 42 for supporting a display such as a video display 44, and a lower space 45 for supporting other components. A plurality of keys 47 are located below video display 44 for receiving input from a person playing device 20. Notably, the cabinet 22 can be positioned on or above a floor. Cabinet 22 defines an open front, which is covered by cabinet access door 24. The open front permits servicing of components in cabinet 22 without moving cabinet 22 away from a building wall against which the cabinet may be positioned.

Cabinet access door 24 is pivotally mounted to cabinet 22 by a hinge 46 on the left side. Cabinet access door 24 includes an upper section 48 defining a window for viewing display 44, and further includes an intermediate section 50 for supporting the keyboard or operator controlled input mechanism 52. A multi-point lockable latch 54 is located on the right side of cabinet 22 for securely latching cabinet access door 24 in the closed position. The opening 26 is located in the lower left corner of cabinet access door 24, although it is contemplated that the opening 26 could be located anywhere on cabinet 22 or on cabinet access door 24.

Bill acceptor door 30 (FIGS. 1 and 4–6) includes a front plate 56 shaped to fit within opening 26 flush with the front surface of cabinet access door 24, the edges of front plate 56 substantially filling opening 26 to prevent unauthorized access to cabinet 22. Perpendicular flanges 58 extend rearwardly around the perimeter of front plate 56. A flat sided lock receiving hole 60 for receiving a lock 61 (FIG. 1) is located on the top of front plate 56. A rectangular aperture of 62 is formed below lock receiving hole 60 for mateably receiving the bill receiving inlet 31*b* of bill acceptor 31 (FIG. 1 ). Several rearwardly extending threaded studs 64 (FIG. 4) are located around aperture 62 for securing bill acceptor 31 to door 30, and several additional rearwardly extending threaded studs 66 are located near the bottom of plate 56 for receiving housing 68.

Bill acceptor housing 68 (FIGS. 4–6) includes a bottom wall 70 and opposing side walls 72 and 74. Walls 70, 72 and 74 define a pocket 76 for receiving bill acceptor 31 and bill collector cartridge 31*a*. Pivot pins 34 extend from side walls 72 and 74 away from pocket 76. Attachment flanges 78 and 80 extend perpendicularly from the front ends of side walls 72 and 74. Attachment flanges 78 and 80 include holes for receiving studs 66. Pivot pins 34 are located a predetermined distance from attachment flanges 78 and 80 (and from bill acceptor door front plate 56 and perimeter flanges 58), to thus define a restrictive space 82. A rectangular aperture 84 is located generally centrally in bottom wall 70, and is engageable by a latching mechanism (not specifically shown) on removable bill collector cartridge 31*a*. Bottom wall 70 terminates short of front plate 56 and defines a gap 86.

Figure 8:
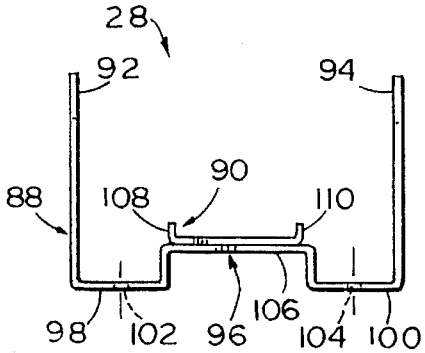
FIG. 8 is a front view of the hinge bracket shown in FIG. 7.

Hinge bracket 28 (FIGS. 7–8) includes a U-shaped member 88 and a tab 90 extending from the U-shaped member 88. U-shaped member 80 includes a pair of L-shaped side arms 92–94 connected by a cross piece 96. Cross piece 96 includes attachment sections 98 and 100 having attachment holes 102 and 104 (FIG. 8) therein to secure hinge bracket 28 to cabinet access door 24, and further includes raised center section 106 for supporting tab 90. Tab 90 includes reinforcement flanges 108 and 110 which extend along the sides of tab 90 to rigidify tab 90.

L-shaped arms 92 and 94 each include a pivot forming end 112 having slots 32 therein, and a finger 114 having an extremity 114*a* defining the forward side of slot 32. Each finger 114 includes a front surface 116, and angled lower edge 118 connected to surface 116, and a horizontal surface 120 connected to angled edge 118. Slot 32 includes an inlet 32*a* and a pivot forming end 32*b*. Slot 32 extends generally parallel to front surface 116 and further extends generally parallel front plate 56 when bill acceptor door 30 is in the closed position "C" (FIG. 10). The width of finger 114 allows finger 114 to mateably slide into the restrictive space 82 between pivot pin 34 and bill acceptor door front plate 56 (adjacent housing flanges 78 and 80) when bill acceptor door 30 is located in the intermediate position "I". Angled lower edge 118 permits the bill acceptor door 30 to move to the open position "O" (FIG. 12) without interference from hinge bracket 28 (FIG. 10). In the open position "O", the lower flange 58 of bill acceptor door 30 engages horizontal surface 120, thus holding bill acceptor door 30 in a horizontal open position.

Bill acceptor 31 (FIG. 1) includes an in-feed mechanism 124 having a bill inlet 126. Bill collecting cartridge 31*a* is releasably attached to in-feed mechanism 124. Bill acceptor 31 is attached to bill acceptor door 30 by studs 64. The bill collecting cartridge 31*a* includes a mechanism for releasably attaching to in-feed mechanism 124 and to aperture 84 in bottom wall 70 of hinge bracket 28. Since this attachment mechanism is not required for an understanding of the present invention, it is not described in the application. However, it is noted that such mechanisms are generally known in the art and are also publicly available. Tab 90 on hinge bracket 28 covers aperture 84 when bill acceptor door 30 is in the closed position, thus providing increased security to bill acceptor 31 by covering the latching mechanism on bill collecting cartridge 31*a*. Bill acceptor door 30 and bill acceptor 31 can be installed or removed as a unit from hinge bracket 28 by positioning bill acceptor door 30 in the intermediate position "I". Notably, the top of bill acceptor 31 provides enough clearance at its top relative to the top of opening 26 to allow pivot pins 34 to slide out of slots 32 when door 30 is in the intermediate position "I". Thus, advantageously, bill acceptor 31 can be assembled to door 30 first, and then subsequently the assembly can be mounted to cabinet 22 as a unit. Bill acceptor 31 is electrically connected to the gaming device central control unit after installation by connecting plug-in electrical connectors commonly known in the art.

Bill acceptor door 30 is normally closed and locked. When bill acceptor 31 is to be emptied, bill acceptor door 30 is unlocked and pivoted to the open position (FIG. 12). Bill acceptor cartridge 31*a* is then removed and replaced by an empty cartridge 31*a*, after which bill acceptor door 30 is again closed and locked. To service the components of gaming device 20, maintenance personnel access the interior of cabinet 22 through the cabinet access door 24. However, bill acceptor cartridge 31 a cannot be removed when cabinet access door 24 is opened unless the maintenance person also has the key for releasing the latching mechanism of the bill collector cartridge. Notably, cabinet access door 24 and bill acceptor door 30 are separately locked to reduce the likelihood of maintenance people accessing the bill acceptor 31 without authority.

To assemble bill acceptor door 30 to gaming device 20, bill acceptor 31 is first attached to bill acceptor door 30. Subsequently, the assembly including bill acceptor door 30 and bill acceptor 32 (and bill collector cartridge 31*a* if desired) is oriented in the intermediate position in opening 26, and then moved linearly so that pivot pins 34 slide into slots 32. Bill acceptor door 30 cannot be removed from hinge bracket 28 when in the closed position "C" since the top of door 30 engages the top of opening 26 thus preventing pivot pins 34 from sliding out of slots 32. Also, as bill acceptor door 30 is pivoted from the intermediate position "I" toward the open position "O", the position of fingers 114 is changed relative to the restrictive space 82 around pivot pins 34 such that the extremity 114*a* of fingers 114 interlockingly engage pivot pins 34 and finger surfaces 116/118 interlockingly engage the back of front plate 56, thus binding and preventing removal of pivot pins 34 out of slots 32 and preventing removal of bill acceptor door 30 from hinge bracket 28 (see FIGS. 10 and 12).

Thus, hinge arrangement is provided which facilitates assembly, but which a secure arrangement that can not be easily surreptitiously overcome. In the foregoing description, it will be readily appreciated by those skilled in the art that modifications may be made to the invention without departing from the concepts disclosed herein. Such modifications are to considered as included in the following claims, unless these claims by their language expressly state otherwise.

The embodiments of the invention in which an exclusive property or privilege is claimed are defined as follows:

1. A gaming device comprising:

a cabinet defining an opening, a bill acceptor door shaped to fit within and cover the opening, and a bill acceptor and a removable bill collector cartridge positioned on the bill acceptor door proximate the opening;

a hinge bracket attached to said cabinet proximate the opening, said hinge bracket including a pair of end sections each defining a hinge-pin-engaging slot and an interlocking finger, said slot including an inlet and a pivot forming end; and a bill acceptor housing attached to said bill acceptor door, said housing defining a pocket for receiving and securely holding the bill acceptor and the bill collector cartridge and including a pair of pivot pins extending from opposing sides of said housing for engaging said pivot-pin-engaging slots, said bill acceptor door being pivotable between a closed position for receiving bills and securely holding the bill collector cartridge in a safe position in the cabinet, an open position for accessing the bill acceptor to remove the bill collector cartridge, and a plurality of intermediate positions between said open and closed positions facilitating assembly of said bill acceptor door to said hinge bracket, said pivot pins, said bill acceptor housing and said bill acceptor door defining a restrictive space therebetween for closely receiving said interlocking fingers, said fingers having a configuration such that said restrictive space allows insertion of said pivot pins into and out of the inlet of said slots only when said bill acceptor door is in one of said plurality of intermediate positions, and prevents withdrawing said pivot pins from said slots through said inlets when said bill acceptor door is between said plurality of intermediate positions and said open position, whereby said bill acceptor door can be easily assembled to said gaming device cabinet by orienting said bill acceptor door in one of said intermediate positions and inserting said pivot pins into said slots through said slot inlets into the pivot forming end of said slots, but said bill acceptor door cannot be removed from said gaming device cabinet when pivoted open beyond said plurality of intermediate positions toward said open position, such as when an operator has opened said bill acceptor door to remove the bill cartridge from the bill acceptor; and a cabinet access door for accessing the cabinet, the cabinet access door including said opening, and said hinge bracket being secured to said cabinet access door proximate said opening.

2. A gaming device as defined in claim 1 wherein said interlocking fingers each include an extremity defining a part of said slot inlet, said extremity defining an increasing distance with the closest part of said bill acceptor door as said bill acceptor door is pivoted toward the open position from the closed position, whereby said extremity engages said pivot pin to securely retain said bill acceptor door to said hinge bracket when said bill acceptor door is between said intermediate position and said open position.

3. A gaming device as defined in claim 1 wherein the length and position of said slots are such that, when the bill acceptor is mounted to the bill acceptor door and said bill acceptor door is positioned in the intermediate position, there is sufficient clearance between said hinge bracket and a top of the opening to allow said bill acceptor door and said bill collector to be assembled to said cabinet as a unit.

4. A gaming device as defined in claim 1 wherein said end sections of said hinge bracket define door engaging surfaces and said bill acceptor door includes material that engages the door engaging surfaces for limiting the rotation of the bill acceptor door when the bill acceptor door is pivoted to the open position, said door engaging surfaces engaging the bill acceptor door after a desired amount of rotation to the open position and preventing over-travel past the open position.

5. A gaming device comprising:

a cabinet defining an opening, a bill acceptor door shaped to fit within and cover the opening, and a bill acceptor and a removable bill collector cartridge positioned on the bill acceptor door proximate the opening;

a hinge bracket attached to said cabinet proximate the opening, said hinge bracket including a pair of end sections each defining a hinge-pin-engaging slot and an interlocking finger, said slot including an inlet and a pivot forming end;

a bill acceptor housing attached to said bill acceptor door, said housing defining a pocket for receiving and securely holding the bill acceptor and the bill collector cartridge and including a pair of pivot pins extending from opposing sides of said housing for engaging said pivot-pin-engaging slots, said bill acceptor door being pivotable between a closed position for receiving bills and securely holding the bill collector cartridge in a safe position in the cabinet, an open position for accessing the bill acceptor to remove the bill collector cartridge, and a plurality of intermediate positions between said open and closed positions facilitating assembly of said bill acceptor door to said hinge bracket, said pivot pins, said bill acceptor housing and said bill acceptor door defining a restrictive space therebetween for closely receiving said interlocking fingers, said fingers having a configuration such that said restrictive space allows insertion of said pivot pins into and out of the inlet of said slots only when said bill acceptor door is in one of said plurality of intermediate positions, and prevents withdrawing said pivot pins from said slots through said inlets when said bill acceptor door is between said plurality of intermediate positions and said open position, whereby said bill acceptor door can be easily assembled to said gaming device cabinet by orienting said bill acceptor door in one of said intermediate positions and inserting said pivot pins into said slots through said slot inlets into the pivot forming end of said slots, but said bill acceptor door cannot be removed from said gaming device cabinet when pivoted open beyond said plurality of intermediate positions toward said open position, such as when an operator has opened said bill acceptor door to remove the bill cartridge from the bill acceptor, and the length and position of said slots being such that, when the bill acceptor is mounted to the bill acceptor door and said bill acceptor door is positioned in the intermediate position, there is sufficient clearance between said hinge bracket and a top of the opening to allow said bill acceptor door and said bill collector to be assembled to said cabinet as a unit; and said bill acceptor housing including an aperture in the housing bottom, and said hinge bracket including a tab-like section for covering said aperture, said tab-like section substantially covering said aperture when said bill acceptor door is in the closed position to prevent tampering with the bill acceptor and the bill collector cartridge through said aperture such as when the cabinet is opened for servicing components in the cabinet.

6. A device comprising:

a cabinet defining an opening and further including a hinge bracket mounted proximate said opening;

a bill acceptor door configured to cover the opening in said cabinet;

a housing mounted to said bill acceptor door, said housing being configured to receive a bill acceptor and a bill collector cartridge, said housing including pivot pins and said hinge bracket including slots for receiving said pivot pins to pivotally mount said bill acceptor door to said cabinet for movement between a closed position wherein said bill acceptor door covers said opening, an open position wherein said bill acceptor door is pivoted outwardly so that the bill collector cartridge mounted on said bill acceptor door is uncovered for removing bills collected and held in the bill collector cartridge, and an intermediate position facilitating assembly, said slot including a pivot forming end;

said housing including an inner surface and said slots extending generally parallel to said inner surface when said bill acceptor door is in said closed position, said pivot pins and said inner surface defining a predetermined restrictive space, said hinge bracket including a finger located at least partially in said predetermined space when said pivot pin is operably mounted in said slot, said finger including an interlocking end positioned proximate said bill acceptor door in said predetermined space when said door is in the closed position and in the intermediate position, but which is positioned away from said bill acceptor door out of said predetermined space when said door is moved past said intermediate position toward said open position, said interlocking end allowing movement of said pivot pins in said slot when said interlocking end is in said predetermined space to facilitate assembly, but preventing movement of said pivot pins out of said pivot forming end of said slots when said interlocking end is located outside of said predetermined space; and a bill acceptor attached to said housing and configured to permit said bill acceptor and bill acceptor door to be assembled as a unit to said hinge bracket.

7. A method of assembling a hinge for a gaming device, comprising:

providing a cabinet including a bracket defining slots and having interlocking fingers;

providing a bill acceptor door for the cabinet, the door including pivot pins for operably engaging the slots to pivotally support the door on the cabinet, and further including material defining a restrictive space for receiving the interlocking fingers;

attaching a bill acceptor to the bill acceptor door;

orienting the door so that the pivot pins will slide into the slots and also the interlocking fingers will slide into the restrictive area;

slideably assembling the door to the bracket by sliding the pivot pins into the slots such that the door is pivotally movable between a closed position, an intermediate position and an opened position;

accessing the bill acceptor by opening the door to the open position; and securely retaining the door to the cabinet when the door is in the open position by engaging the interlocking fingers against the material defining the restrictive area.

* * * * *

UNITED STATES PATENT AND TRADEMARK OFFICE

CERTIFICATE OF CORRECTION

PATENT NO. : 5,515,959
DATED : May 14, 1996
INVENTOR(S) : Orlando W. Stephenson, III et al.

It is certified that error appears in the above-indentified patent and that said Letters Patent is hereby corrected as shown below:

Abstract, line 4;
"tile" should be –the–.

Abstract, line 15;
"tile" should be –the–.

Column 1, line 19;
"tile" should be –the–.

Column 1, line 25;
"tile" should be –the–.

Column 1, line 53;
"tile" should be –the–.

Column 1, line 60;
"frown" should be –from–.

Column 1, line 61;
"tile" should be –the–.

UNITED STATES PATENT AND TRADEMARK OFFICE

CERTIFICATE OF CORRECTION

PATENT NO. : 5,515,959
DATED : May 14, 1996
INVENTOR(S) : Orlando W. Stephenson, III et al.

It is certified that error appears in the above-indentified patent and that said Letters Patent is hereby corrected as shown below:

Column 2, line 25;
"ginning" should be –gaming–.

Signed and Sealed this

Twenty-sixth Day of November 1996

*Attest:*

Bruce Lehman

BRUCE LEHMAN

*Attesting Officer*

*Commissioner of Patents and Trademarks*